US010677428B2

(12) United States Patent
Ray et al.

(10) Patent No.: US 10,677,428 B2
(45) Date of Patent: Jun. 9, 2020

(54) LIGHTING SYSTEM

(71) Applicants: Steven Howard Ray, Longmont, CO (US); Brett James Pardikes, Frederick, CO (US); Christopher M. White, Frederick, CO (US)

(72) Inventors: Steven Howard Ray, Longmont, CO (US); Brett James Pardikes, Frederick, CO (US); Christopher M. White, Frederick, CO (US)

(73) Assignee: LEDVANCE LLC, Wilmington, MA (US)

( * ) Notice: Subject to any disclaimer, the term of this patent is extended or adjusted under 35 U.S.C. 154(b) by 0 days.

(21) Appl. No.: 16/406,425

(22) Filed: May 8, 2019

(65) Prior Publication Data

US 2019/0264896 A1 Aug. 29, 2019

Related U.S. Application Data

(63) Continuation of application No. 15/991,715, filed on May 29, 2018, now Pat. No. 10,309,626, which is a (Continued)

(51) Int. Cl.

| | |
|---|---|
| ***F21V 21/008*** | (2006.01) |
| ***F21V 29/74*** | (2015.01) |
| ***F21V 23/00*** | (2015.01) |
| ***F21S 8/00*** | (2006.01) |
| ***F21S 9/02*** | (2006.01) |
| *F21V 23/04* | (2006.01) |
| *F21V 3/00* | (2015.01) |
| *F21S 4/20* | (2016.01) |

(Continued)

(52) U.S. Cl.

CPC ..... *F21V 21/008* (2013.01); *F21S 8/03* (2013.01); *F21S 9/022* (2013.01); *F21V 23/004* (2013.01); *F21V 23/007* (2013.01); *F21V 29/74* (2015.01); *F21S 4/20* (2016.01); *F21S 8/04* (2013.01); *F21V 3/00* (2013.01); *F21V 3/02* (2013.01); *F21V 15/015* (2013.01); *F21V 23/0471* (2013.01); *F21V 29/507* (2015.01); *F21Y 2115/10* (2016.08)

(58) Field of Classification Search

CPC ..... F21V 21/008; F21V 21/02
USPC ..... 362/218, 249.1, 247
See application file for complete search history.

(56) References Cited

U.S. PATENT DOCUMENTS

2011/0051414 A1* 3/2011 Bailey ..... F21V 3/00 362/235
2012/0306377 A1* 12/2012 Igaki ..... F21V 23/0464 315/151

(Continued)

*Primary Examiner* — Allyson N Trail
(74) *Attorney, Agent, or Firm* — Tutunjian & Bitetto

(57) ABSTRACT

A lighting system and related methods are disclosed herein. The lighting system may have a mounting fixture and a light fixture. The mounting fixture is configured to engage a mounting surface. The light fixture is configured to engage the mounting fixture and has a driver configured to drive a light source. A first fastener having a movable elongated member is configured to removably couple the light fixture to the mounting fixture in an extended configuration. A second fastener having a quick connect feature is configured to removably couple the light fixture to the mounting fixture in a retracted configuration.

18 Claims, 13 Drawing Sheets

Related U.S. Application Data continuation of application No. 15/146,516, filed on May 4, 2016, now Pat. No. 9,989,224.

(60) Provisional application No. 62/156,354, filed on May 4, 2015.

(51) Int. Cl.

| | |
|---|---|
| *F21S 8/04* | (2006.01) |
| *F21V 3/02* | (2006.01) |
| *F21V 15/015* | (2006.01) |
| *F21V 29/507* | (2015.01) |
| *F21Y 115/10* | (2016.01) |

(56) References Cited

U.S. PATENT DOCUMENTS

| | | | | |
|---|---|---|---|---|
| 2013/0020450 | A1* | 1/2013 | Beausoleil | F21V 21/02 248/205.1 |
| 2013/0051017 | A1* | 2/2013 | Heim | F21S 8/04 362/247 |
| 2013/0235568 | A1* | 9/2013 | Green | F21V 3/06 362/218 |
| 2013/0301267 | A1* | 11/2013 | Badley | F21V 19/00 362/249.1 |
| 2016/0240056 | A1* | 8/2016 | Chen | G08B 13/2491 |
| 2017/0038040 | A1* | 2/2017 | May | F21V 3/0625 |
| 2017/0130938 | A1* | 5/2017 | Seward | F21S 8/026 |

* cited by examiner

LIGHTING SYSTEM

CLAIM OF PRIORITY UNDER 35 U.S.C. § 119

The present Application for Patent claims priority to Non-Provisional application Ser. No. 15/146,516 filed May 4, 2016, which claims priority to Provisional Application No. 62/156,354 entitled "Flexible Surface-Mounted Light Source" filed May 4, 2015, and assigned to the Assignee hereof, the entire contents of which are hereby expressly incorporated by reference herein.

BACKGROUND

Field

The present invention relates generally to lighting systems, and more specifically to lighting fixtures.

Background

Installation and maintenance of lighting units, and in particular LED lighting units, may be time-consuming, require specialized tools, or otherwise present difficulties and challenges. For example, those skilled in the art will recognize that light fixtures generally are heavy, and require an installer to disassemble and/or assemble as many as five different components during installation. Moreover, currently-available light fixtures require that the installer hold the heavy fixture while coupling power sources; in commercial applications requiring the installation of hundreds of fixtures, easing the burden on the installers and speeding the rate of installation can save thousands of dollars.

Currently-available light fixtures are also prone to excessive heat generation, which may result in a degradation of performance of electronics carried therein.

Currently-available light fixtures are also prone to premature damage or breaking, particularly in rough environments such as dorms or manufacturing buildings.

A need therefore exists for a lighting unit that is easier and simpler to install and maintain, less prone to performance degradation, and/or can withstand impacts or rough handling.

SUMMARY

In one example, a lighting system is provided. The exemplary lighting system has a mounting fixture and a light fixture. The mounting fixture is configured to engage a mounting surface. The light fixture is configured to engage the mounting fixture and has a driver configured to drive a light source. A first fastener having a movable elongated member is configured to removably couple the light fixture to the mounting fixture in an extended configuration. A second fastener having a quick connect feature is configured to removably couple the light fixture to the mounting fixture in a retracted configuration.

In another example, a method of installing a lighting system is provided. The exemplary the method includes providing a mounting fixture, a light fixture, a first fastener, and a second fastener. Providing includes providing a mounting fixture configured to engage a mounting surface. Providing further includes providing a light fixture configured to engage the mounting fixture and comprising a driver configured to drive a light source. Providing further includes providing a first fastener comprising a movable elongated member. Providing further includes providing a second fastener comprising a quick connect feature. The exemplary method further includes using the first fastener to removably couple the light fixture to the mounting fixture in an extended configuration. The method further includes using the second fastener to removably couple the light fixture to the mounting fixture in a retracted configuration.

In another example, a light fixture for a lighting system is provided. The exemplary light fixture includes a driver configured to drive a light source, a first fastener, and a second fastener. The first fastener includes a movable elongated member and is configured to removably couple the light fixture to a mounting fixture in an extended configuration.

The second fastener includes a quick connect feature and is configured to removably couple the light fixture to the mounting fixture in a retracted configuration.

DETAILED DESCRIPTION

Embodiments of the present invention include a lighting system that is easily mounted on a building wall or ceiling surface, regardless of the type of electrical connections that are present, is easily installed by service personnel, and is easily and conveniently disassembled for service in the field. The lighting system may also be configurable to produce linear light sources of arbitrary lengths, in some embodiments because of its modular construction.

In various embodiments, one or more support cables (two cables in some embodiments) connect a mounting plate or fixture to a light fixture which may carry a light source. The support cables allow the light fixture to hang suspended from the mounting plate at a distance sufficient to permit maintenance on the components of the light source; the distance may be, for example, 10, 20, or 30 cm (though any distance is contemplated herein).

One or more pins may connect the mounting plate to the light source when the light source is in its normal, non-suspended state. In some embodiments, four pins (and corresponding holes in the light source and mounting plate)

are used. The holes are aligned such that a hole in the light source aligns with a hold in the mounting plate, and each pins passes through both corresponding holes to affix the two objects to each other. A force may be required to remove the pins from the holes; this force may be a result of friction between the pins and the surface of the holes, a result of features in the profile of the pins mating with corresponding features in the surface of the holes, or by any other means. The force may be great enough so that the pins do not unintentionally fall out of the holes but weak enough to permit removal with only finger strength. In some embodiments, the profile of the pin is such that a lip or similar protrusion prevents the pin from being fully withdrawn from one of the holes (in either the mounting plate or the light source, whichever is on the exterior face of the combined unit so that the pin may be withdrawn from the other of the mounting plate or light source). In some embodiments, bolts or screws may be used in lieu of the pins.

In some embodiments, an installer of the mounting plate and light source first affixes the mounting plate to a surface, such as a ceiling, with screws, bolts, nails, glue, or similar fasteners. The installer then attaches the support cables, and then the pins.

Figure 1:
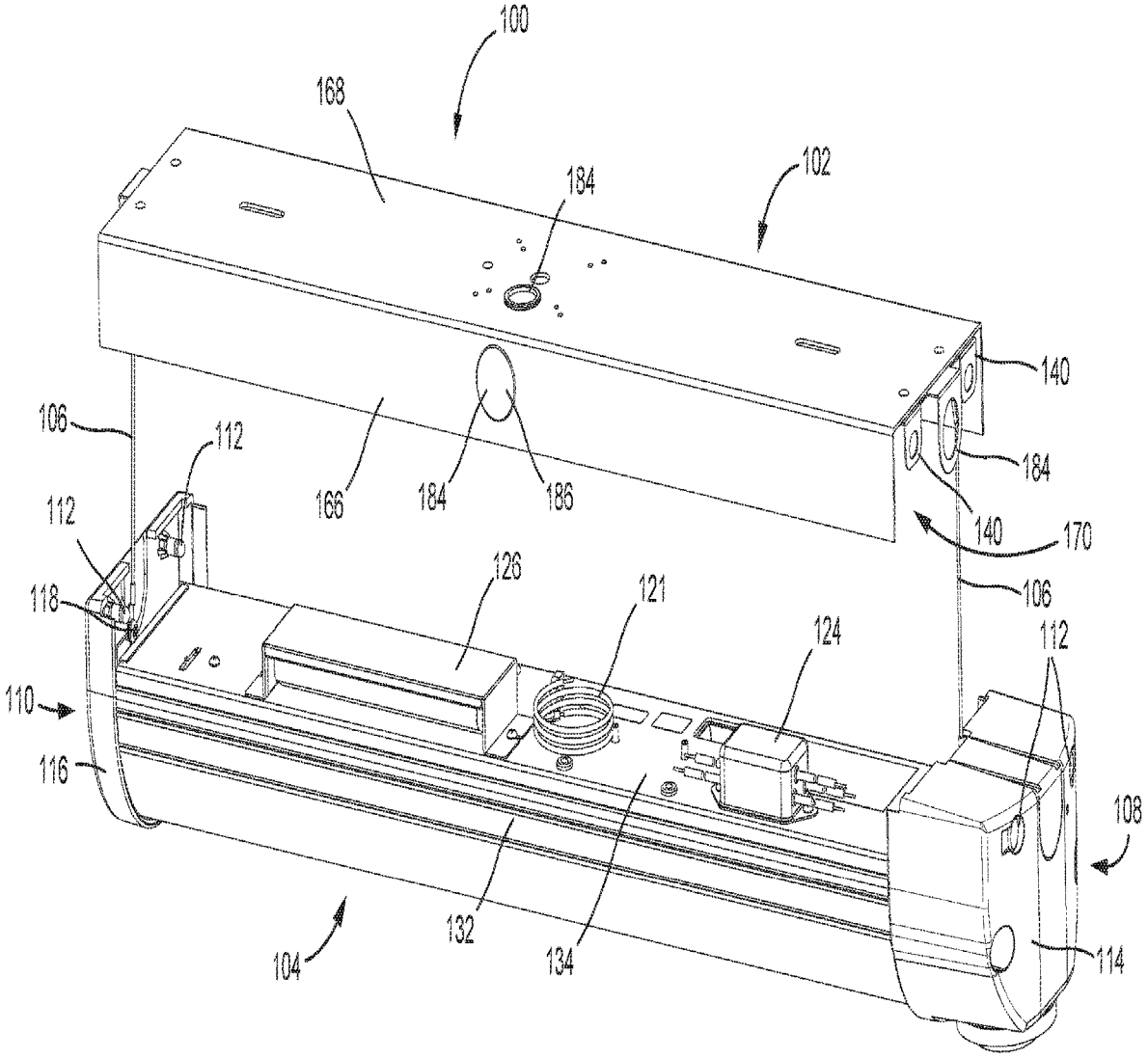
FIG. 1 is a perspective view of a light fixture in an expanded configuration.
Figure 2:
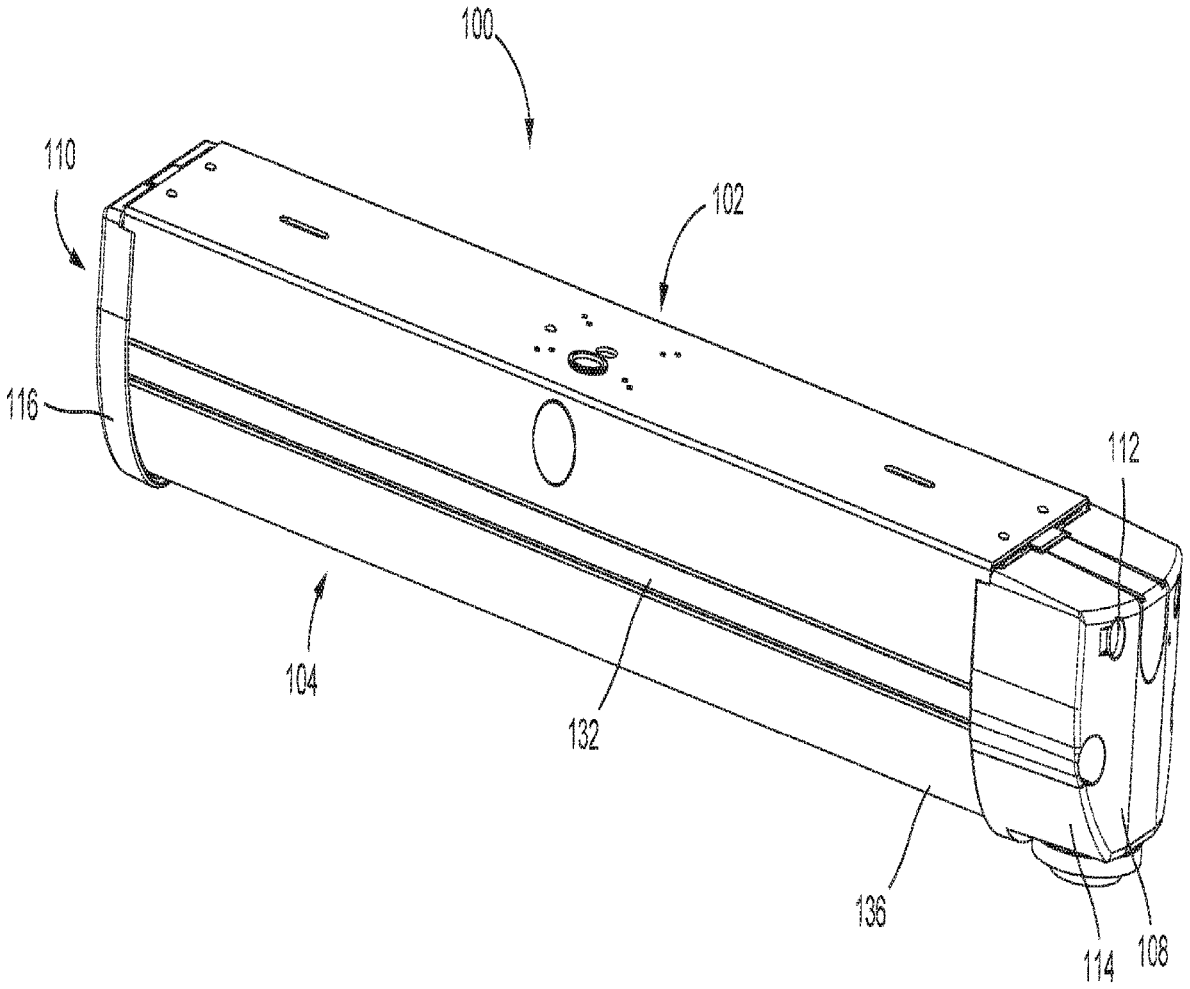
FIG. 2 is a perspective view of the light fixture in FIG. 1 in a contracted configuration.
Figure 3:
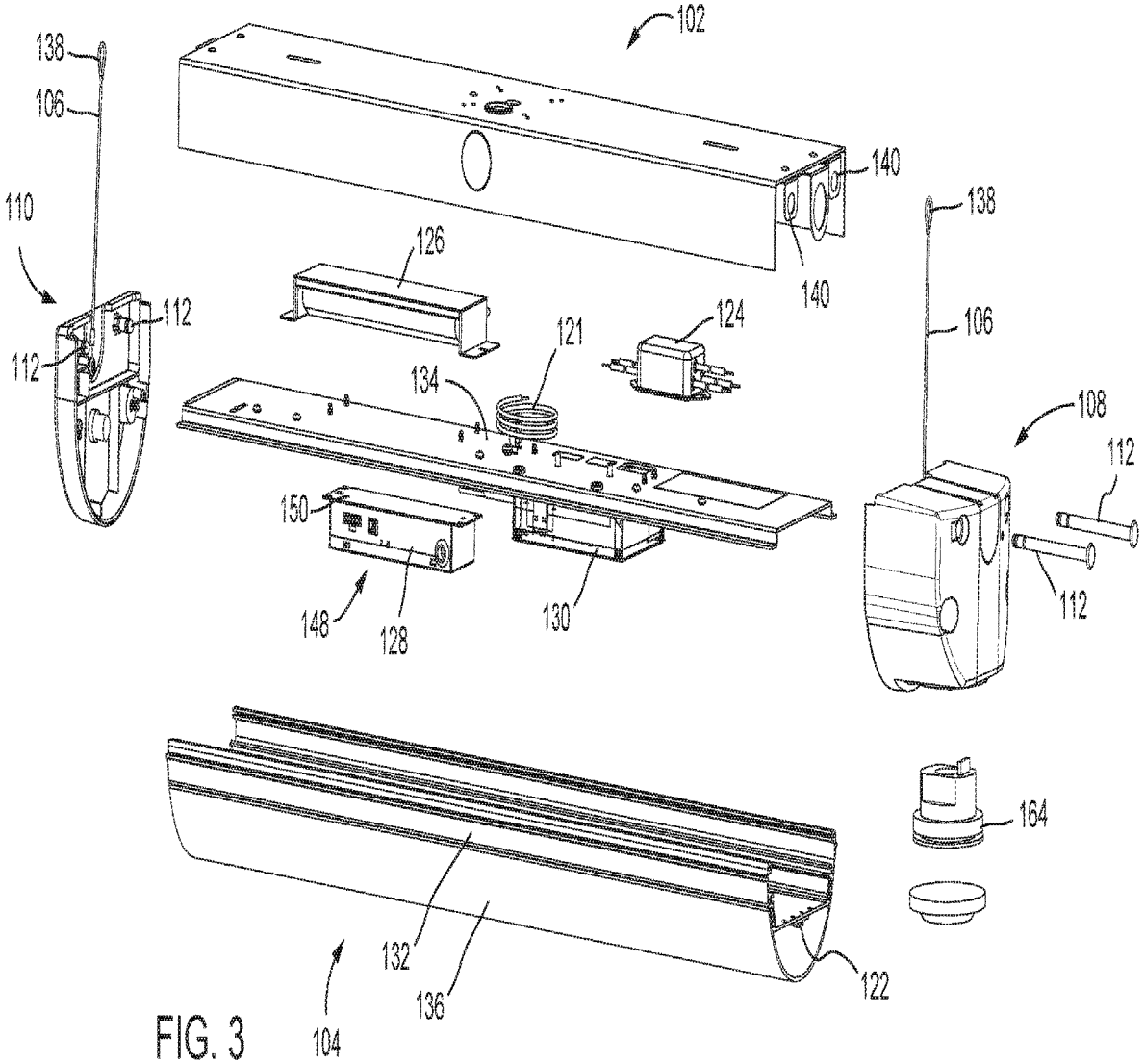
FIG. 3 is a perspective view of some components of the light fixture in FIG. 1.

Turning now to FIGS. 1-3, a lighting system 100 according to some embodiments is now described. The lighting system 100 may have a mounting fixture 102, and a light fixture 104 configured to be coupled to the mounting fixture 102 in an extended position by way of one or more first fasteners 106. The one or more first fasteners 106 may couple the light fixture 104 to the mounting fixture 102 such that the light fixture 104 hangs from the mounting fixture 102, and is movable and/or removable from the mounting fixture 102. Those skilled in the art will recognize that the system 100 illustrated in FIGS. 1-3, as illustrated, if configured for attachment to an overhead feature such as a ceiling. However, a system 100 configured for attachment to a vertical surface such as a wall is also contemplated herein. For example, the one or more first fasteners 106 or light fixture 104 may, in some embodiments, be configured to hang adjacent to or from a first side 166 of the mounting fixture 102 while a second side 168 of the mounting fixture 102 may be configured for engagement with a mounting surface, such as a wall. In some embodiments, the light fixture 104 or first fastener(s) 106 are configured to hang from or be adjacent a side 170 that opposes the second side 168, which may be configured for engagement with a mounting surface that is a ceiling or other substantially horizontal surface. In some embodiments, the light fixture 104 or first fastener(s) 106 may be adaptable, and configured to hang from or be positioned in either orientation, that is, relative to the sides 166, 170 in the extended configuration.

The first fastener(s) 106 may have a movable elongated member. For example, the first fastener(s) 106 may be attached to a first end cap 114 and/or a second end cap 116 in a permanent or semi-permanent manner. For example, one or more third fastener(s) 118 may couple the first fastener(s) 106 to the end cap(s) 114, 116, as most clearly illustrated in FIG. 1. The first fastener(s) 106 may be one or more flexible members that bend, contract, or fold as the installer moves the light fixture 104 towards the mounting fixture 102. The first fastener(s) 106 may be one or more wires or cables that are positioned in an interior space 120 defined between the mounting fixture 102 and the light fixture 104 (see e.g. FIG. 12 for a better understanding of the space 120).

Those skilled in the art will generally understand that, although the first fastener(s) 106 are depicted as a flexible cable, the first fastener(s) 106 may include any number of means for removably and/or movably attaching the light fixture 104 to the mounting fixture 102, including, but not limited to, a cable, chain, a spring, a push-pull linkage.

In some embodiments, and as illustrated in FIG. 3, a hook and eye engagement 138 is provided for coupling the light fixture 104 to the mounting fixture 102 in the extended position (see FIG. 1).

Continuing with FIGS. 1-2, one or more second fasteners 112 may be provided for coupling the light fixture 104 to the mounting fixture 102 in a retracted position. In some embodiments, the one or more second fastener(s) 112 may be threaded and configured to engage one or more recesses 140 in the mounting fixture 102 and/or the light fixture 104. In some embodiments, the second fastener(s) 112 may include interference fit features between the mounting fixture 102 and the light fixture 104. In some embodiments, the second fastener(s) 112 may have a quick connect feature. In some embodiments, a detent 112 and recess 140 may be provided for coupling the light fixture 104 to the mounting fixture 102 in the retracted configuration. The detent 112 may be spring-biased. In some embodiments, the quick connect feature includes pins 112 that can be pried open using a flathead screwdriver or other similar tool. In some embodiments, a detent in the mounting fixture 104 is configured to engage a passage in the light fixture (not illustrated), such that the light fixture 104 may be fastened to the mounting fixture by simply sliding the light fixture 104 onto the mounting fixture 102. To disassemble, the detent on the mounting fixture 102 may be depressed using a tool, and the light fixture 104 may be slid off the mounting fixture 102. In some embodiments, the detent is a one-way detent; that is, the detent may have an angled surface on a lower portion and a flat surface on an upper portion so that the light fixture 104 does not fall off the mounting fixture 102 after installation.

In some embodiments, the second fastener(s) 112 may include a hook and eye connection. In some embodiments, end caps 114, 116 may provide a disguising effect, and may be coupled to the rest of the light fixture 104 before or after connecting the light fixture 104 in the retracted configuration.

As previously mentioned, the mounting fixture 102 may be configured for attachment to a mounting surface, such as, for example, a ceiling, wall, floor, stair, or any other surface, and may be coupled to or configured to be coupled to one or more power source conduits 212, 214 (see e.g. FIG. 6) on, behind, or extending through the mounting surface. The mounting fixture 102 may be removably or permanently attached to the mounting surface with screws, bolts, nails, glue, and/or any other fasteners now known or as yet to be developed. The mounting surface itself may be substantially vertical, horizontal, angled, and/or curved, and may be made of any materials suitable for receiving a lighting system 100, including natural features such as outdoor rocks or walls, or indoor features such as walls or ceilings. Moreover, although the system 100 illustrated is configured for engagement with a mounting surface that is substantially planar, in some embodiments, the system 100 may be configured for engagement with a curved mounting surface, such as, for example, a curved wall, in an aesthetically pleasing manner.

Figure 6:
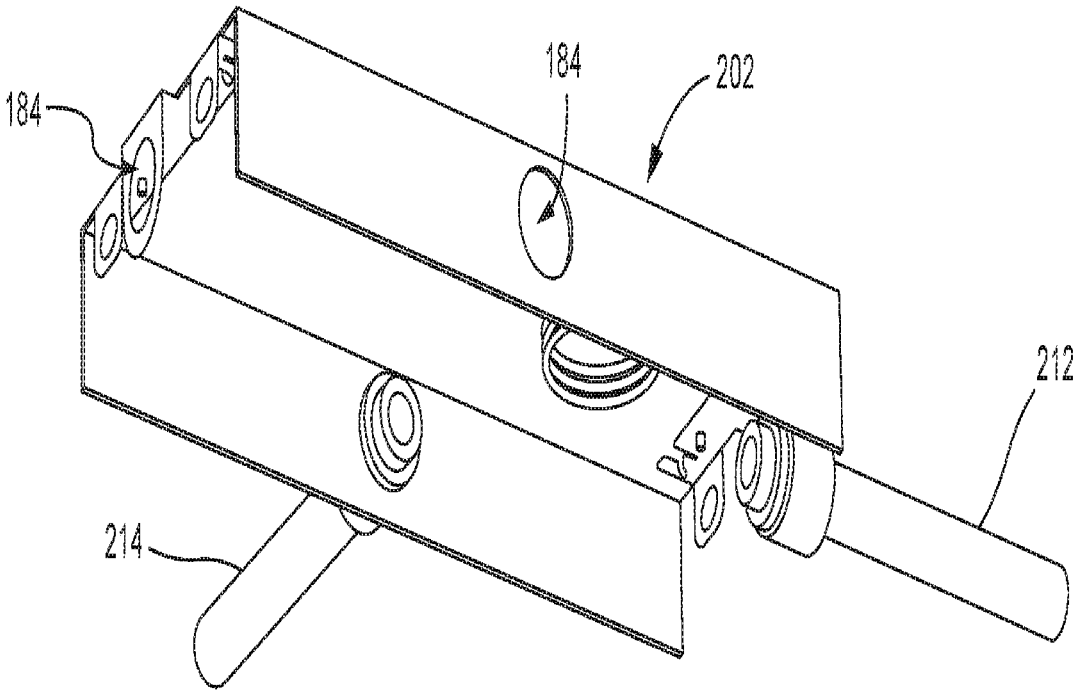
FIG. 6 is a perspective view of a mounting bracket and conduit, without wires.

In some embodiments, the mounting fixture 102 has multiple power line conduit entry points 184 entry points for power lines and conduits 212, 214 carrying power lines (see e.g. FIGS. 1 and 6). In some embodiments, some or all of the entry points 184 are always open. In some embodiments, some or all of the entry points 184 include a punch-out wall 186 to provide an aesthetically pleasing surface 166 if not all entry points 184 are in use.

Continuing with FIGS. 1-2, and as previously mentioned herein, the light fixture 104 may be coupled to the mounting fixture 102 in an extended configuration by way of one or more first fasteners 106, and in a retracted configuration by way of one or more second fasteners 112. Specifically, in some examples, an installer may couple the mounting fixture 102 to the mounting surface, such as a junction box 300 illustrated in FIG. 4. After mounting the mounting fixture 102, the installer may hang the light fixture 104 onto the mounting fixture 102 by way of the first fastener(s) 106, at which time the installer may couple, fasten, or fix any necessary power, such as the wiring 121 illustrated in FIG. 1.

In some embodiments, the light fixture 104 is movable or installable as a unit. That is, the light fixture 104 may (a) include or be configured to carry and/or drive a light source 122 such as an LED light source 122, 222 (see e.g. FIGS. 3, 11), (b) include wiring 121 for coupling to the mounting fixture 102, include a battery regulator 124, a battery back-up 126, a driver 128, and a processing device 130. In some embodiments, the light fixture 104 has a first heatsink 132 and a second heatsink 134. In some embodiments, the light fixture 104 has a light diffuser 136. The heatsinks 132, 134 and the diffuser 136 are discussed in further detail in subsequent section of this document.

Continuing with FIGS. 1-3, in some embodiments, an installer may attach the mounting fixture 102 to a mounting surface, such as the junction box 300 (FIG. 4) while the light fixture 104 is left sitting on another surface (e.g. on a floor). After the installer has attached the mounting fixture 102, the installer may lift the light fixture 104 and hang the light fixture 104 onto the mounting fixture 102 in an extended configuration by way of one or more first fasteners 106. That is, the first fastener(s) 106 maintain the light fixture 104 in a position distant from, but supported by, the mounting fixture 102, to allow the installer access for coupling wires, power lines, and/or other connections without having to manually support the light fixture 104 during coupling of the wires, etc. When ready, the installer may then bring the light fixture 104 into a retracted position (see e.g. FIG. 2), and couple the light fixture 104 to the mounting fixture 104 by way of one or more second fasteners 112.

Figure 4:
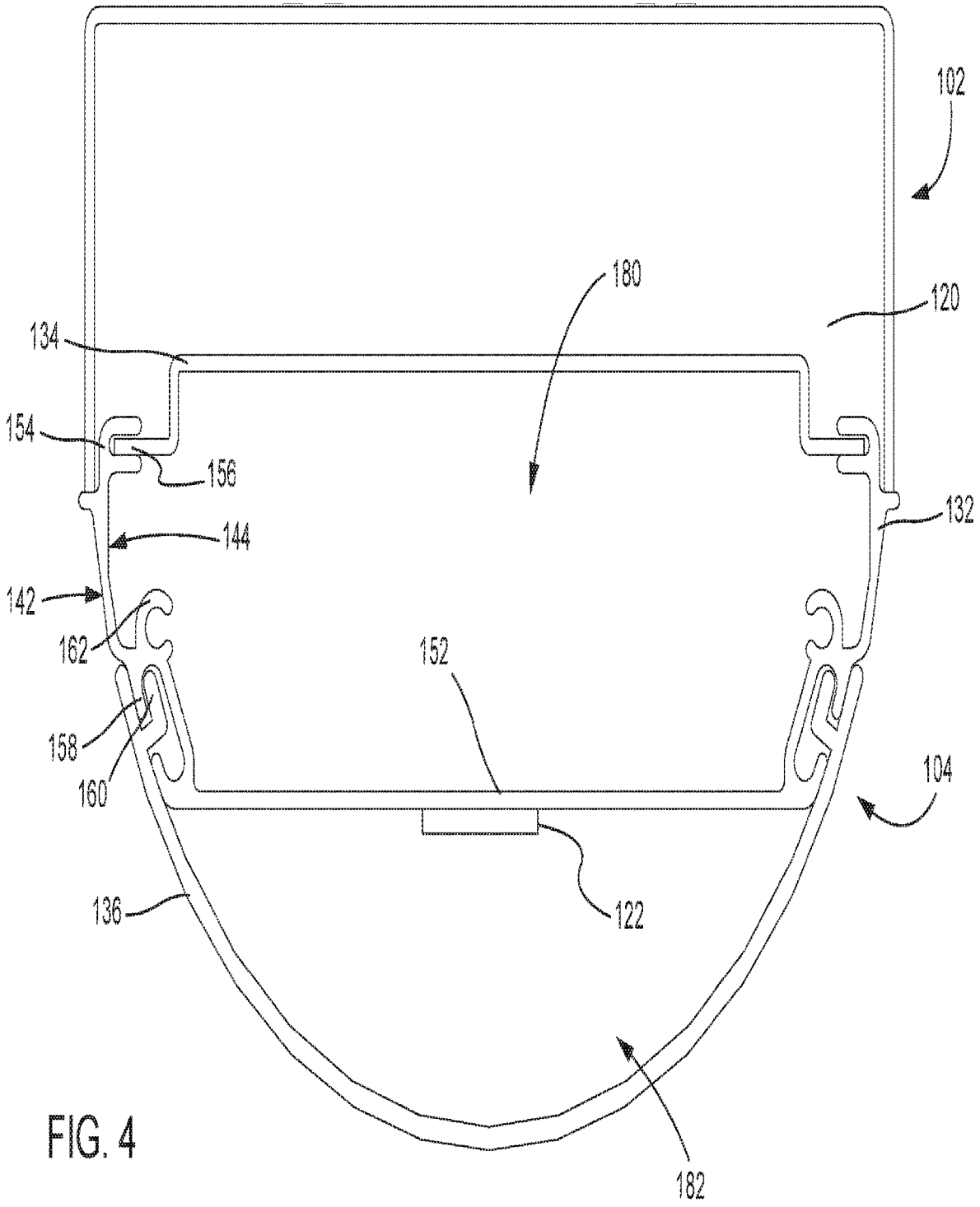
FIG. 4 is an end section view of some components of the light fixture in FIG. 1.

Turning now to FIG. 4, a relationship between the first heatsink 132 and the second heatsink 134 is now described in further detail. In some embodiments, the first heatsink 132 and the second heatsink 134 may be coupled together to define an interior space 180 therebetween, and at least one of the first heatsink 132 or 134 having an exterior surface 142 exposed to a space exterior of the light source. That is, the first and second heatsinks 132, 134 may be configured to conduct thermal energy from multiple interior compartments 180, 182, 120 of the light fixture 104 to the exterior space.

In some embodiments, the exterior surface 142 includes a plurality of fins (not illustrated) so as to improve heat transfer to the exterior space. In some embodiments, the exterior surface 142 has a substantially flat surface. In some embodiments, the exterior surface 142 has an aesthetically pleasing design. In some embodiments, the exterior surface 142 has a plurality of ridges and valleys that increase the surface area exposed to air outside the light fixture 104. Those skilled in the art will recognize that either of the heatsinks 132, 134 may provide the exterior surface 142.

Additionally, or in the alternative, the first and second heatsinks 132, 134 may be configured to conduct thermal energy from multiple heat-generating components in different compartments 180, 182, 120 of the lighting system 100. For example, the light source 122 may be positioned between the first heatsink 132 and the diffuser 136. Relatedly, the driver 128 and processing device 130 may be positioned between the first and second heatsinks 132, 134, so that the heatsinks 132, 134 both provide thermally conductive paths from the components 128, 130 to the exterior surface 142. The battery regulator 124 and backup 126 may be positioned between the second heatsink 134 and the mounting fixture 102.

In some embodiments, heat-sensitive components 128, 130, that is, those components that are most prone to performance degradation by exposure to heat, may be positioned in the coolest compartment 180 of the light fixture 104. The coolest compartment 180 may be that space positioned between the first and second heatsink 132, 134. As of the time of this writing, the heat-sensitive components 128, 130 may be the processing device 130 and/or the driver 128; however, those skilled in the art will recognize that technological advances may change this presumption, and that other heat-sensitive components 128, 132 may be or become more suitable for positioning between the first and second heatsinks 132, 134.

In some embodiments, the space 182 defined by the first heatsink 132 and the diffuser 136 may reach the highest temperatures. Therefore, the first heatsink 132 may have a plate portion 152 that provides a thermal barrier between the coolest compartment 130 and the hottest compartment 182. The plate portion 152 may have a thickness that is defined by the anticipated temperature difference between the two compartments 180, 182 so as to ensure that heat from the light source 122 does not pass through to the heat-sensitive components 128, 130. In some embodiments, the heat-sensitive components 128, 130 are coupled to the second heatsink 134 to provide a direct thermally conductive path from the heat-sensitive components 128, 130, through the second heatsink 134 and to the exterior surface 142 (and first heatsink 132). Those skilled in the art will recognize that the thermally conductive paths defined by the first and second heatsinks 132, 134 are more thermally conductive than is the air in the compartments 180, 182, 120. In some embodiments plate portions in both of the heatsinks 132, 134 may be provided, each of the plate portions having a thickness defined by the anticipated temperature difference between first and second compartments 180, 182 and/or between second and third compartments 180, 120. In some embodiments, a thickness of the plate in the first heatsink 132 is different from a thickness of the plate in the second heatsink 134.

In some embodiments, the first heatsink 132 is an elongated thermally conductive material positioned adjacent to, above, or on a first side of a light source 122. That is, a light source 122 may be positioned between the first heatsink 132 and the diffuser 136. The first heatsink 132 may have an exterior surface 142 exposed to a space exterior of the light source 104 and an interior surface 144 exposed to an interior space defined by the first heatsink 132 and the second heatsink 134.

In some embodiments, at least a portion of the first heatsink 132 is positioned between a light source 122 or light source receptacle 246 (see e.g. receptacle 246 in FIG. 12) and a first side 148 of the driver 128 (see e.g. FIG. 3).

In some embodiments, at least a portion of the second heatsink 134 is positioned adjacent a second side 150 of the driver 128.

In some embodiments, the first heatsink 132 and the second heatsink 134 are coupled together to define a thermally conductive path from the light source 122 or light source receptacle 246 and the driver 128 to a space exterior of the light fixture 104.

In some embodiments, the first heatsink 132 has a plate portion 152 exposed to the space defined by the first and second heatsinks 132, 134 and/or a space defined by the first heatsink 132 and the diffuser 136.

The plate portion 152 may be coupled to a first flange portion 154. The first flange portion 154 may be slidingly engaged with a flange 156 in the mounting fixture 102. In some embodiments, the first heatsink 132 includes a second flange portion 158 slidingly engaged with a flange 160 in the diffuser 136. Providing a sliding engagement between the first heatsink 132 and the light diffuser 136 introduces a level of robustness not found in currently-available systems that require snap-fitting the diffuser to the mounting features. This level of robustness reduces the chances of the diffuser 136 and light source 122 being broken when exposed to rough environments.

Continuing with FIG. 4, the first heatsink 132 may include fastening features 162 for coupling one or more end caps 114, 116 to the first heatsink 132, although those skilled in the art will understand that the end caps 114, 116 may be fastened to the light fixture 104 using any suitable means.

In some embodiments, additional thermal isolation means may be provided to insure that the heat-sensitive components 128, 130 are protected, although the inventors have found that the sliding engagement between the heatsinks 132, 134 provides sufficient thermal isolation for their purposes for the level of heat generated by currently-available LED light sources 122. The additional thermal isolation means may include insulating tape, insulating paste, insulating gel, insulating plastic, ceramic, and/or polymer extrusions that fit in the compartment 180 between the two heatsinks 132, 134, or any other thermal isolation means now known or as-yet to be developed.

In some embodiments, those components subject to more frequent maintenance are positioned on the second heatsink 134 such that those components are more easily accessible. For example, the battery 126 may be made accessible to a user by moving the light fixture 104 into the expanded configuration. Conversely, the driver 128 and processing device 130 are not subject to routine maintenance, and may be placed between the two heatsinks 132, 134 so as to discourage a user from interfering with those components. Similarly, one or both of the end caps 114, 116 and diffuser 136 may be removable to expose the light source 122 for maintenance or replacement.

In some embodiments, the light fixture 104 includes a motion sensor 164, as illustrated in FIG. 2. The motion sensor 164 may provide signals to the processing device 130 that are indicative of whether or not a person is in proximity of the light fixture 104. The processing device 130 may be responsive to the motion sensor 164 and configured to adjust a level of light emitted by a light source 122 coupled to the light fixture 104 between a first non-zero level of light and a second non-zero level of light. That is, the light source 104 may be configured to dim without shutting off when a motion sensor 164 provides signals consistent with a room or space being empty.

In some embodiments, the driver 128 and/or processing device 130 are configured substantially as described in commonly-owned U.S. Pat. Nos. 9,326,346 and/or 8,358,085, and/or U.S. Patent Publication No. 2011/0121760. The entire contents of these patents and publication are hereby incorporated by reference in their entirety as if fully set forth herein and for all proper purposes. In some embodiments, the lighting system 100 has a thermal control circuit (note illustrated) configured to increase a lifetime of a light source 122 coupled to the light fixture 104. The thermal control circuit may include circuitry for determining a current thermal operating point of the light source 122 coupled to the light fixture 104. The thermal control circuit may also include circuitry for obtaining a thermal operating range of the light source 122, a generator for generating a control signal that adjusts power delivered to the light source 122 based at least in part on the current thermal operating point and the thermal operating range. The thermal control circuit may be coupled to or reside in the processing device 130.

In some embodiments, an interchangeable light diffuser 136 may be provided. For example, the diffuser 136 may be removable upon removal of the caps 114, 116 to allow an installer to adjust a level of diffusion and/or to control diffusion to different regions of a space such as a 180 degree viewing angle. For example, a first diffuser 136 may provide a "batwing" type diffusion pattern, wherein most of the light is directed to the sides, and less light is directed below or in front of the lighting system 100. A second diffuser 136 may provide a spotlight effect. A third diffuser 136 may provide a patterned effect.

Figure 5:
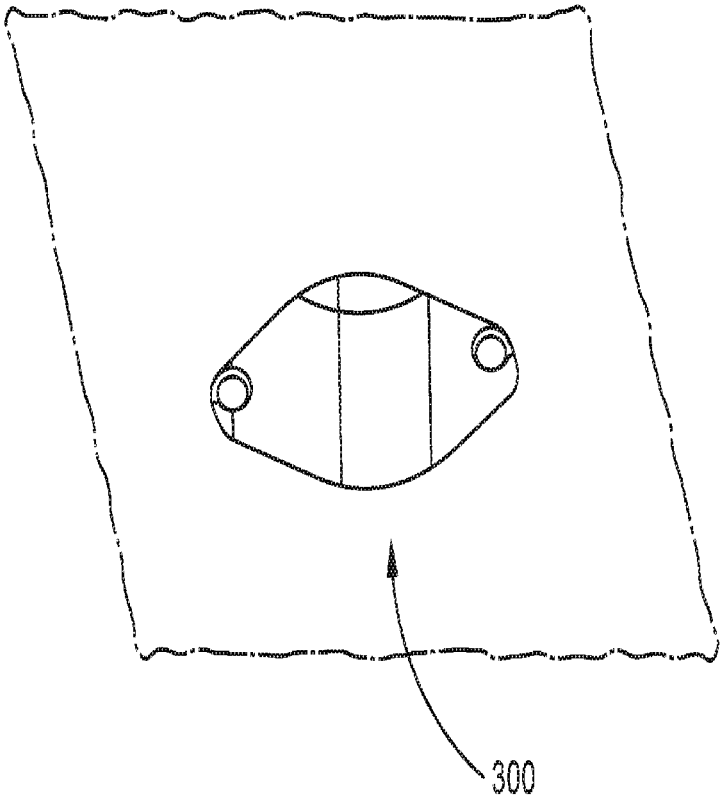
FIG. 5 is a perspective view of a recess to which a light fixture may be attached.

FIG. 5 illustrates a typical installation in which a junction box containing line voltage wiring is recessed above a ceiling surface.

Turning now to FIG. 6, it illustrates a mounting plate or mounting fixture 202 that, unless otherwise described, is substantially similar or identical to the mounting fixture 102 previously described herein. The mounting fixture 202, 102 may be attached to a mounting surface, such as, for example, a ceiling, wall, floor, stair, or any other surface, and may be coupled to or configured to be coupled to one or more power source conduits 212, 214 on the mounting surface. The one or more conduits 212, 214 may be both the entrance and the continuation of a source of power and illustrate the several ways in which conduits 212, 214 may be attached to the mounting fixture 204 of the lighting system 200. The mounting fixture 202 may be removably or permanently attached to the mounting surface with screws, bolts, nails, glue, and/or any other fasteners now known or as yet to be developed.

Of note, power cables or wires are not depicted in the figures for simplicity; however, those skilled in the art will understand that the conduits 212, 214 may house or support one or more power cables or wires. Holes 184 may be present on all sides (or a subset of the sides) of the mounting fixture 202, such as four side, or more, or less to allow a variety of configurations for the wiring. The mounting fixture 202 may include an extrusion with mounting brackets attached to either end 208, 210 with fasteners. The extrusion permits mounting fixtures of various lengths to be produced from a single extrusion, and common end mounting brackets.

Figure 7:
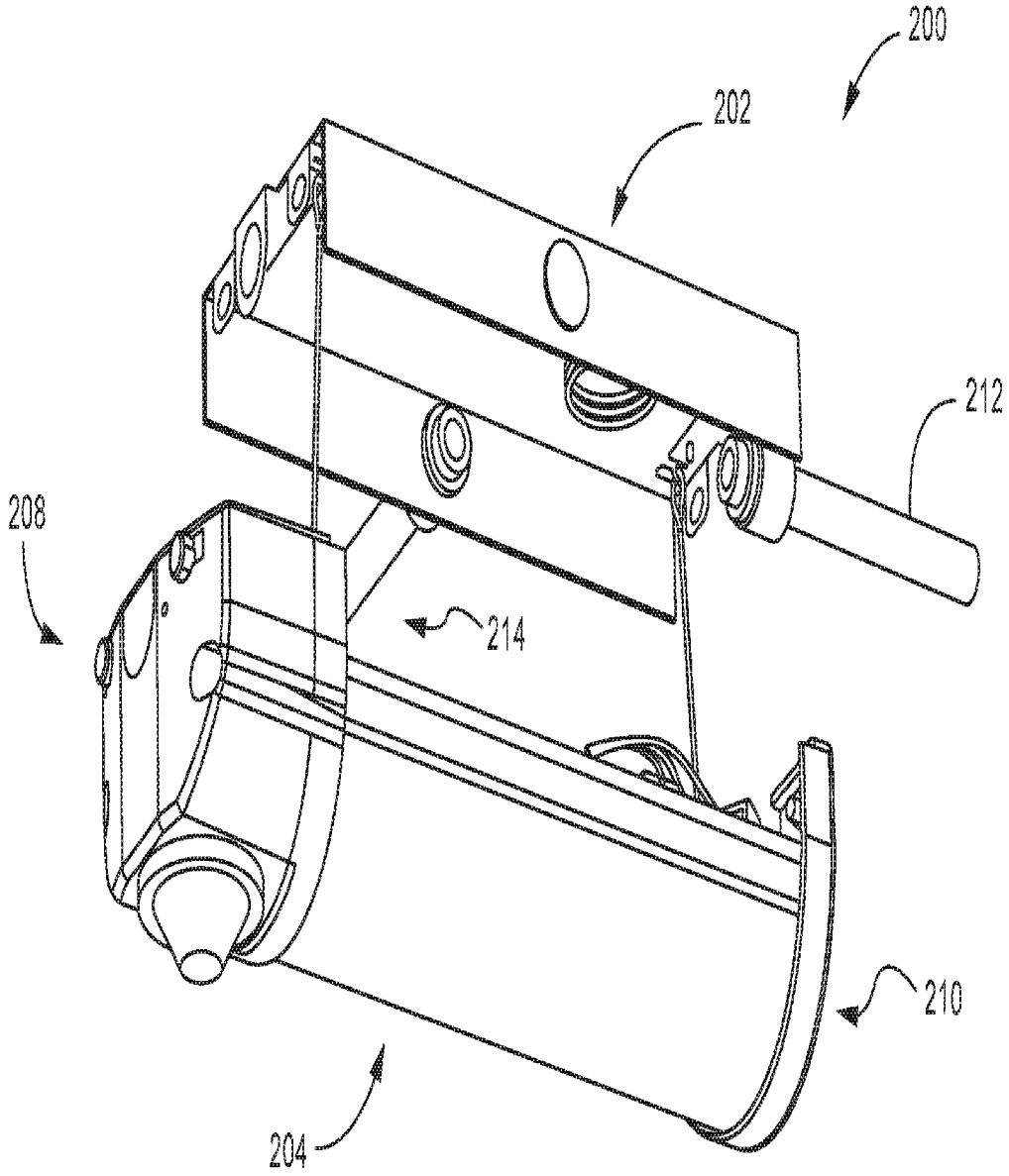
FIG. 7 is a perspective view of a light fixture in an expanded configuration.

Turning now to FIG. 7, it illustrates the mounting fixture 202 with support wires or cables attached that mechanically connect the mounting fixture 202 to a light fixture 204 below. This arrangement allows the light fixture 204 to be conveniently supported while the installer attaches electrical wires to the source or performs service on the light fixture 204 such as replacing the batteries in the case of a battery backup fixture. Such a fixture 204 may be configured to turn on automatically when the electrical power has failed.

Figure 8:
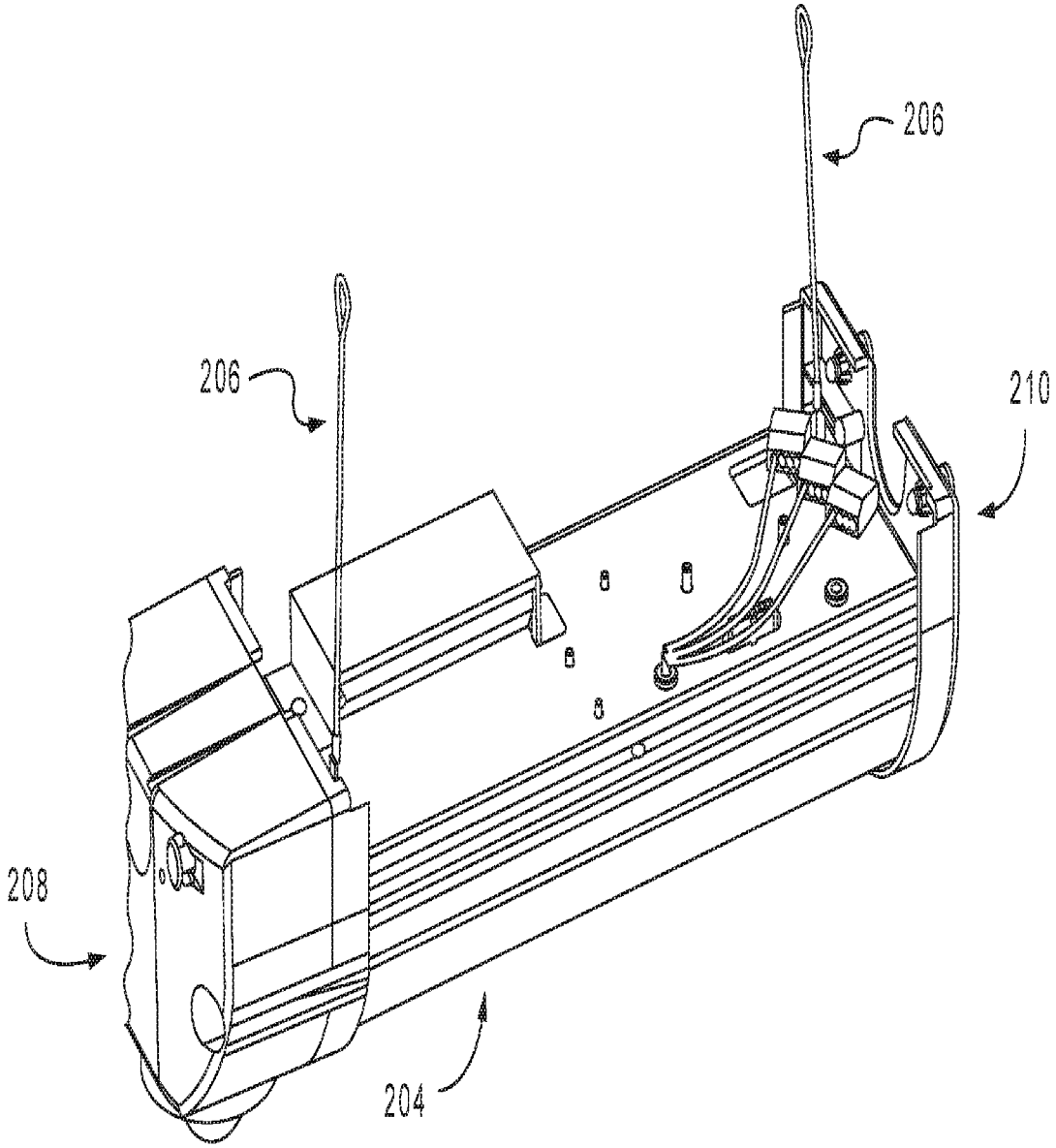
FIG. 8 is a perspective view of some components of the light fixture in FIG. 7.

FIG. 8 illustrates a light fixture 204 suspended from a mounting fixture 202 without the mounting fixture 202 present. The electrical connections to the light fixture 204 are shown on the top surface of the light fixture 204. Also shown on the top surface is a battery (left side) under an enclosure. Mounting of the battery on this surface, together with the support wires, makes it convenient to service the light fixture 204 by removing and replacing the battery. Replacing the battery may be a frequent occurrence.

Figure 9:
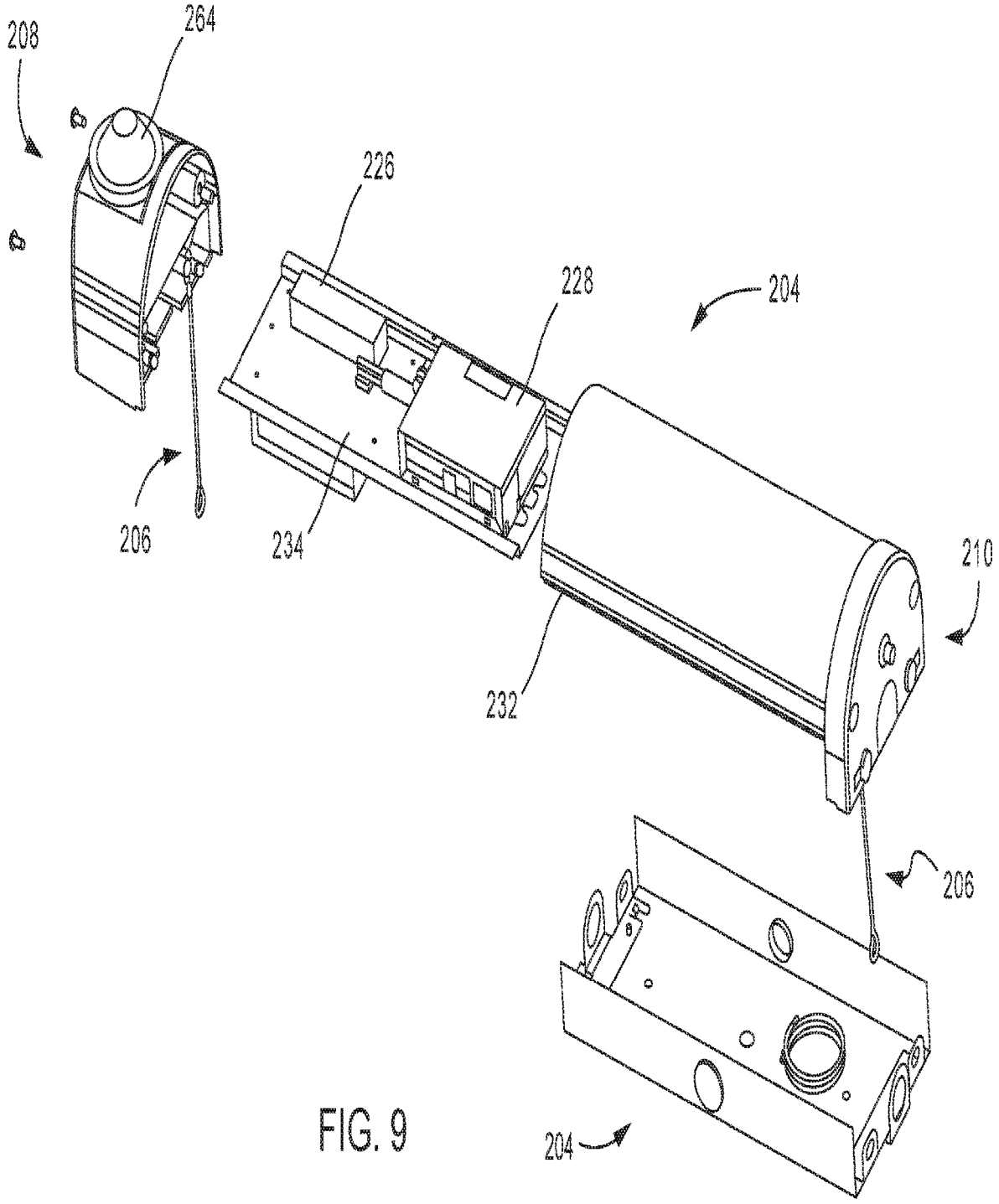
FIG. 9 is a perspective view of some components of the light fixture in FIG. 7.
Figure 10:
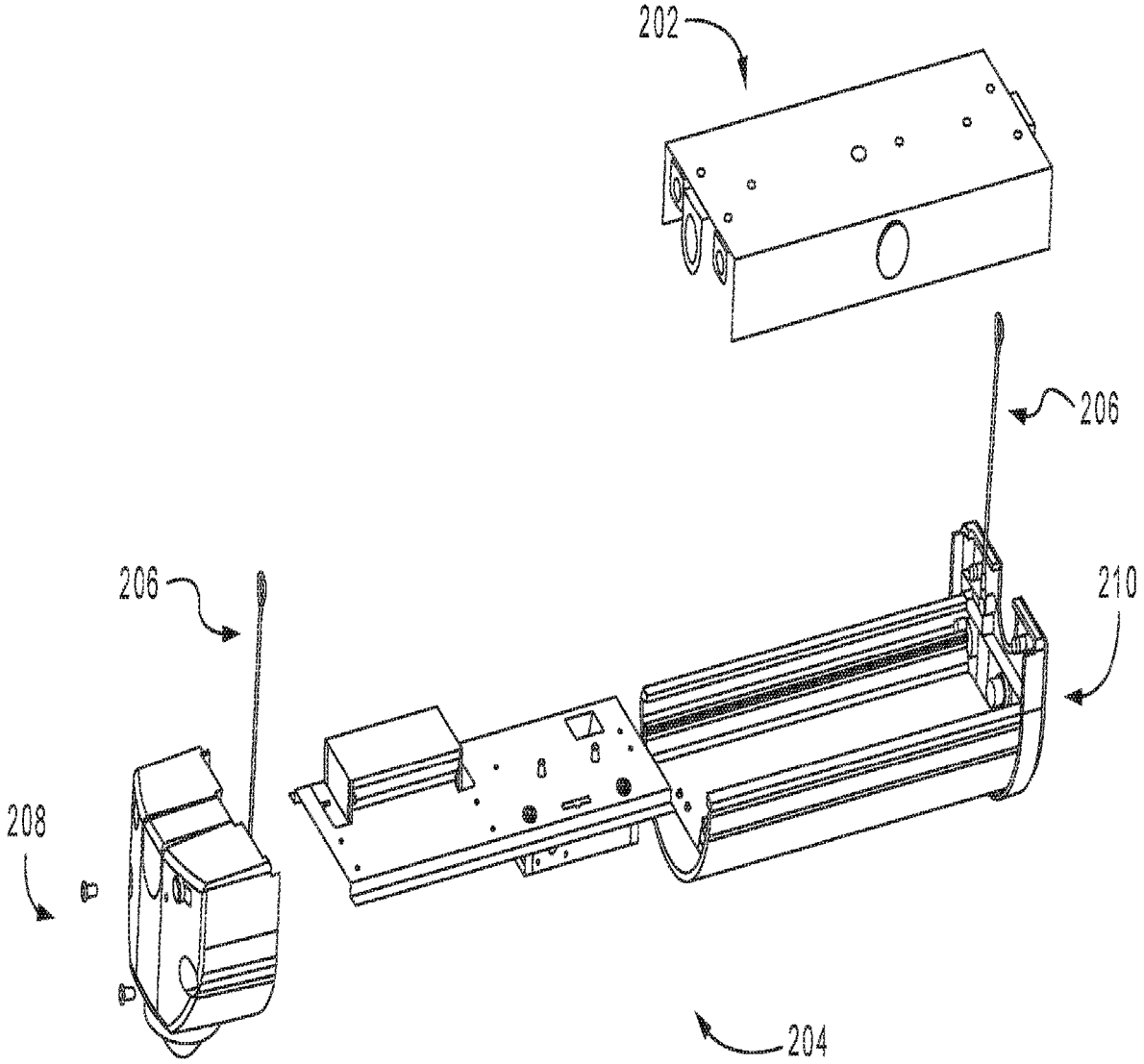
FIG. 10 is a perspective view of some components of the light fixture in FIG. 7.

FIGS. 9-10 are exploded views of the light fixture 204 and mounting fixture 202 from below and above respectively. These illustrations show the assembly of the lighting system 200 which may be comprised of an extrusion 234 that serves as a battery 126 and driver 128 tray, and two end caps that support the tray. Another extrusion 232 shown with the remaining end cap attached in each view serves as side rail and a surface onto which a light source 222 (see FIG. 12) such as LEDs are mounted. One of the end caps may be configured to optionally contain a motion or other sensor 264 which is electrically connected to the LED driver 228.

Figure 11:
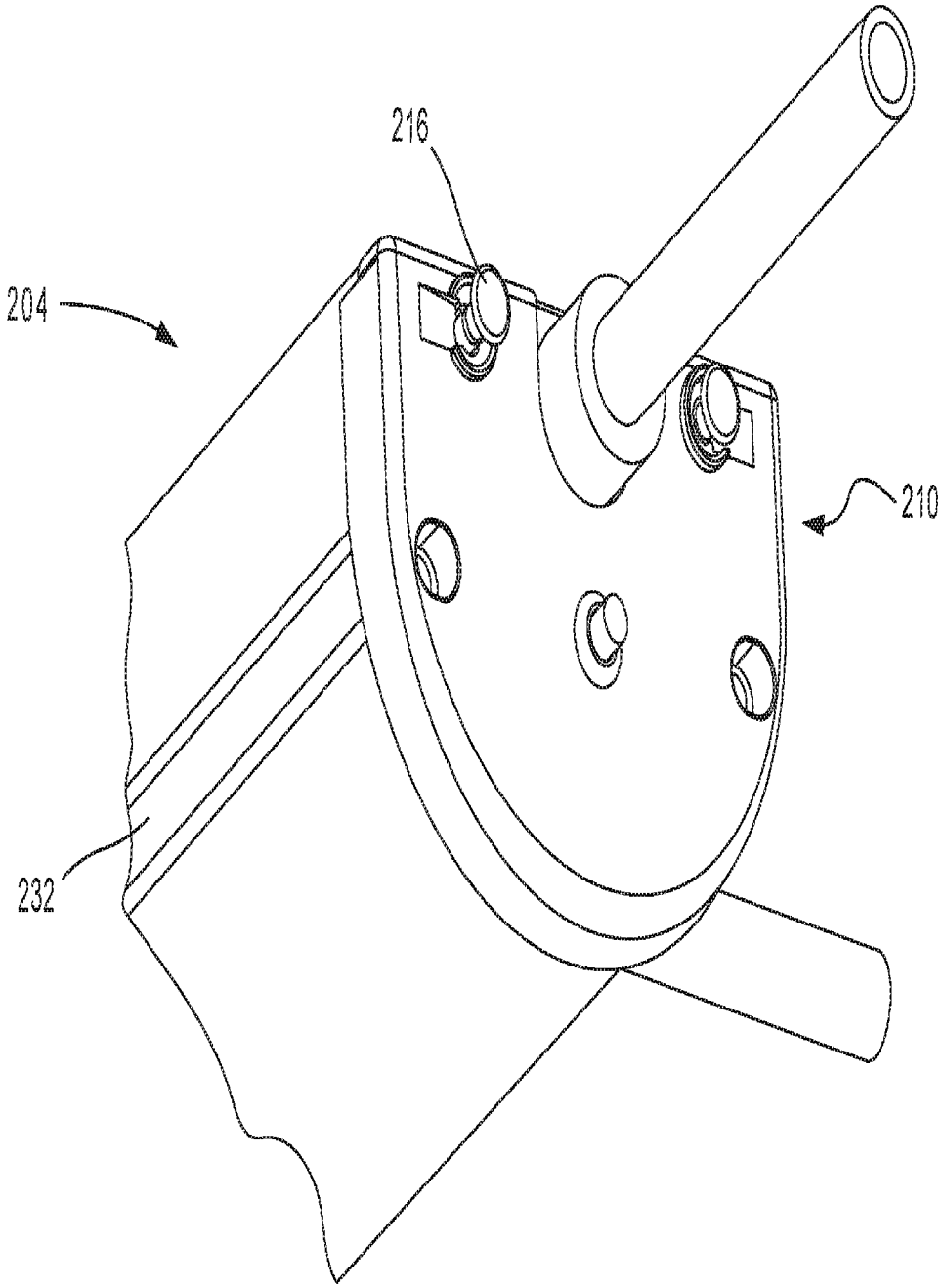
FIG. 11 is a detailed view of some components of the light fixture in FIG. 7.

As illustrated most clearly in FIG. 11, in some embodiments, two pins 216 are disposed outside the two endcaps. These pins are aligned with the two holes on each end of the mounting bracket assembly. Therefore when the light fixture 204 is pushed up to the mounting fixture 202, the pins may be pushed in manually, and without the use of tools to fix the light fixture 204 in place by engaging the light fixture 204 with the mounting fixture 202.

Likewise, the pin(s) 216 may be easily withdrawn to free the light fixture 204 for service. The pins may have features that prevent them from falling out of the end caps of the light fixture 204, such as a tapered profile, a lip or wedge that mates with a corresponding feature of the end cap, and/or a profile that provides a friction force with respect to the end caps.

Figure 12:
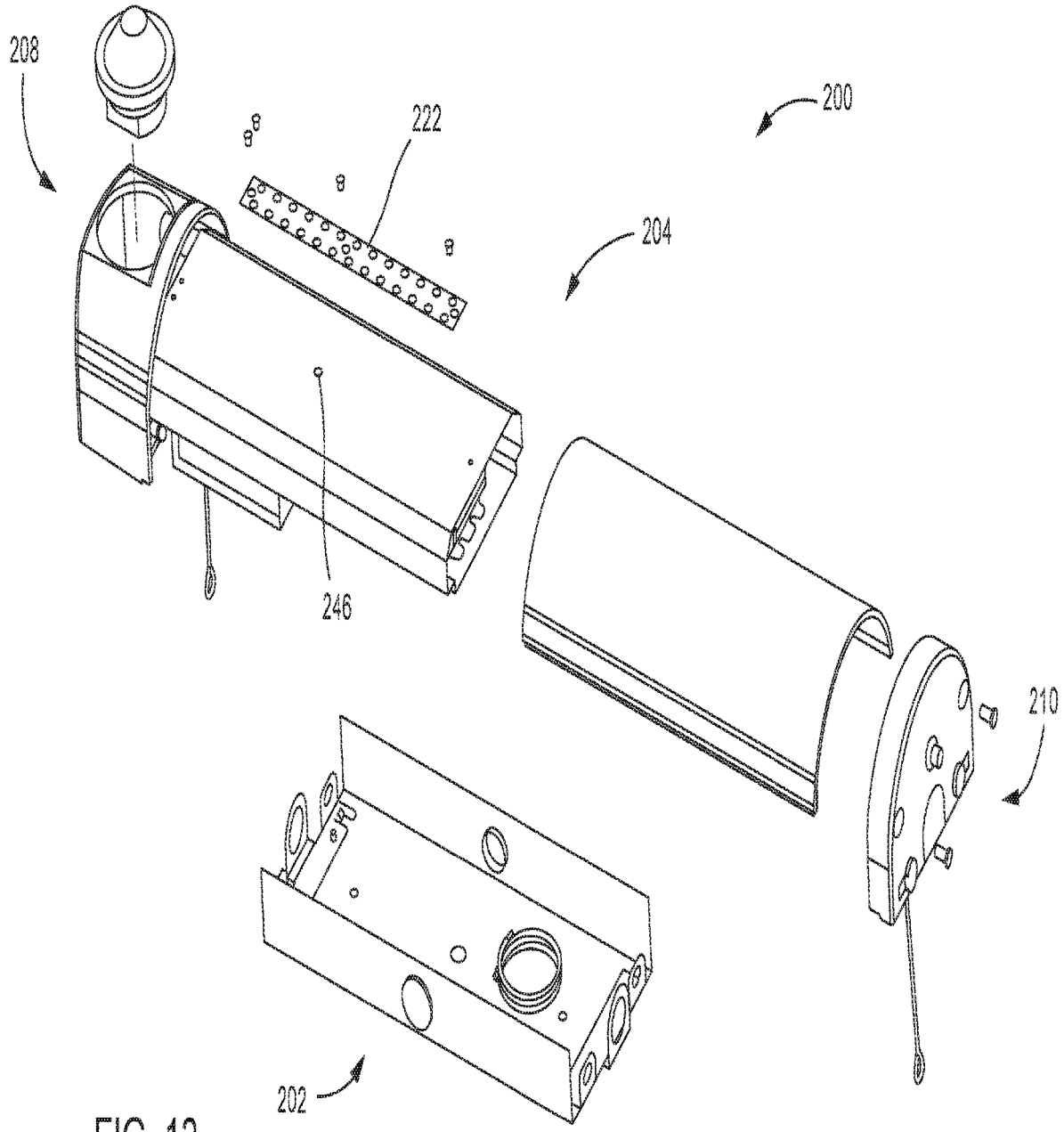
FIG. 12 is a perspective view of some components of the light fixture in FIG. 7.

FIG. 12 is an exploded view of the light source that shows the LED PCB which is mounted onto the fixture extrusion of FIGS. 9-10. That extrusion, together with the driver tray, forms a channel that holds the LED driver and wires that are connected to the LED PCB. The end caps serve to complete the enclosure. The driver is normally not subject to routine maintenance and so removal is usually required.

Figure 13:
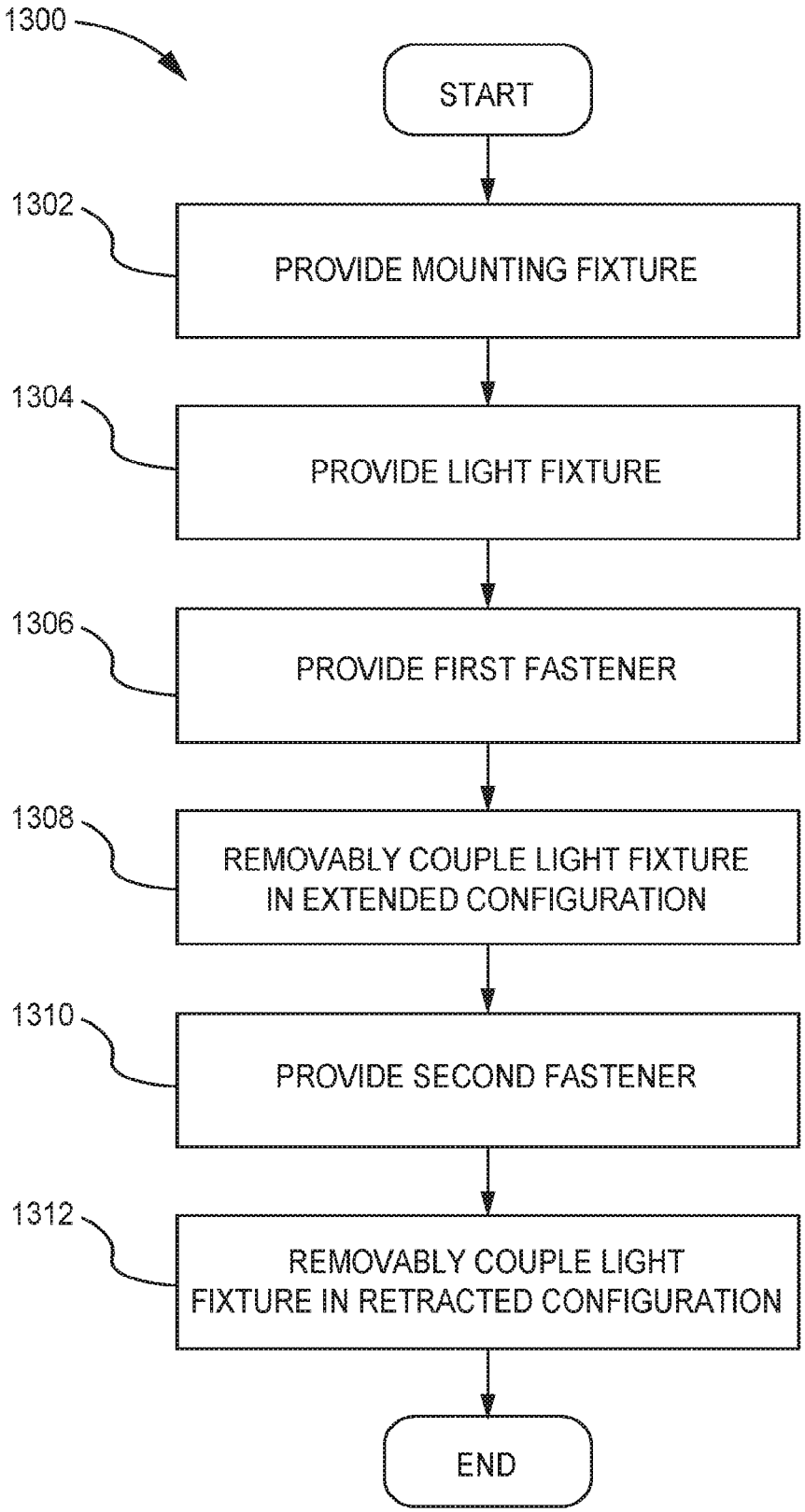
FIG. 13 is a flowchart of a method.

Turning now to FIG. 13, a method 1300 of installing a lighting system is disclosed herein. The method 1300 includes providing 1302 a mounting fixture, providing 1304 a light fixture, providing 1306 a first fastener, removably coupling 1308 the light fixture in an extended configuration, providing 1310 a second fastener, and removably coupling 1312 the light fixture in a retracted configuration. The method 1300 may be performed using any of the lighting systems 100, 200 previously disclosed herein.

Removably coupling 1308 the light fixture in the extended configuration comprises using the first fastener to removably couple the light fixture.

Removably coupling 1312 the light fixture in the retracted configuration comprises using the second fastener to removably couple the light fixture.

The method 1300 may include providing a first heatsink for dissipating heat generated by a light source coupled to the light fixture, and/or providing a second heatsink distinct from the first heat sink and for dissipating heat generated by the driver.

The method 1300 may include positioning at least a portion of the first heatsink between a light source receptacle and a first side of the driver, wherein the first portion is shaped to define a thermal barrier between the light source and the driver; and wherein providing a second heatsink comprises providing a second heatsink wherein at least a portion of the second heatsink is positioned adjacent a second side of the driver, the second side opposing the first side.

The method 1300 may include sliding the first heatsink or the second heatsink onto the other one of the first heatsink or the second heatsink.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. For example, while some embodiments of the invention have been described with respect to embodiments utilizing LEDs, light sources incorporating other types of light-emitting devices (including, e.g., laser, incandescent, fluorescent, halogen, or high-intensity discharge lights) may similarly achieve variable beam divergence if the drive currents to these devices are individually controlled in accordance with the concepts and methods disclosed herein. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "fastener" should be understood to encompass disclosure of the act of "fastening"—whether explicitly discussed or not—and, conversely, were there only disclosure of the act of "fastening", such a disclosure should be understood to encompass disclosure of a "fastening mechanism". Such changes and alternative terms are to be understood to be explicitly included in the description.

The previous description of the disclosed embodiments and examples is provided to enable any person skilled in the art to make or use the present invention as defined by the claims. Thus, the present invention is not intended to be limited to the examples disclosed herein. Various modifications to these embodiments will be readily apparent to those skilled in the art, and the generic principles defined herein may be applied to other embodiments without departing from the spirit or scope of the invention as claimed.

The invention claimed is:

1. An end cap for a light fixture comprising:

a housing having an interior surface for having a first engagement surface for engaging at least one end surface of at least one component mounting structure of the light fixture and a second engagement surface for engaging an optical diffuser to position a light source between said at least one component mounting structure and the optical diffuser; and a motion sensor entirely present on an exterior surface of the end cap, wherein the motion sensor produces signals indicative of whether a person is in a room in which the end cap is present, and the signals produced by the motion sensor are configured to set a level of light emitted by the light source between a first non-zero level of light and a second non-zero level of light.

2. The end cap of claim 1, wherein the light source includes light emitting diodes (LEDs).

3. The end cap of claim 2, wherein the first engagement surface includes a first set of openings through the housing for a first set of fasteners to engage while the end cap is being fastened to the at least one component mounting structure.

4. The end cap of claim 2, wherein the at least one component mounting structure is a ceiling mounted bracket.

5. The end cap of claim 4, wherein the interior surface of the end cap includes a receiving structure for engaging a flexible elongated member that provides to removably couple the end cap of the light fixture to ceiling mounted bracket in an extended configuration so that the light fixture and mounting fixture are separated from one another.

6. The end cap of claim 3, wherein the second engagement surface includes a second set of openings through the housing for a second set of fasteners to engage while the end cap is being fastened to the optical diffuser.

7. A lighting device component comprising:

an end cap body having an interior surface and an exterior surface, the interior surface of the end cap body including a first engagement surface for engagement to a ceiling mounting housing for an elongated lighting fixture having and a second engagement surface for engagement to an optical diffuser, wherein a light source for the elongated lighting fixture is positioned between the ceiling mounting housing and the optical diffuser; and a motion sensor engaged directly to an exterior surface of the end cap body.

8. The end cap of claim 7, wherein the motion sensor produces signals indicative of whether a person is in a room in which the end cap is present.

9. The end cap of claim 8, wherein the signals produced by the motion sensor are configured to set a level of light emitted by the light source between a first non-zero level of light and a second non-zero level of light.

10. A lighting device comprising:

a light housing bracket for an elongated lighting fixture for engagement to a wall or ceiling surface;

a light source;

an optical diffuser; and at least one end cap comprising a body having an interior surface and an exterior surface, the interior surface of the body for the end cap including a first engagement surface for engagement to an end of the light housing bracket and a second engagement surface for engagement to an end of the optical diffuser, wherein the light source is positioned between the ceiling mounted housing and the optical diffuser; and a motion sensor engaged directly to an exterior surface of the end cap body.

11. The end cap of claim 10, wherein the motion sensor produces signals indicative of whether a person is in a room in which the end cap is present.

12. The end cap of claim 11, wherein the signals produced by the motion sensor are configured to set a level of light emitted by the light source between a first non-zero level of light and a second non-zero level of light.

13. The lighting device of claim 10, wherein the light source includes light emitting diodes (LEDs).

14. The lighting device of claim 13, wherein the optical diffuser includes a receiving slot along its length, wherein the light source is mounted to a component mounting structure that is retained within the receiving slot of the optical diffuser.

15. The lighting device of claim 14, wherein the component mounting structure is a heat sink.

16. The lighting device of claim 14, wherein a battery back up is mounted to the component mounting structure.

17. The lighting device of claim 14, wherein a driver is mounted to the component mounting structure.

18. The lighting device of claim 10, wherein the interior surface of the body of the end cap includes a receiving structure for engaging a flexible elongated member that provides to removably couple the end cap of the lighting device to the light housing bracket in an extended configuration so that the lighting device and the light housing bracket are separated from one another.

* * * * *